US010506912B2

(12) United States Patent
Kopera et al.

(10) Patent No.: US 10,506,912 B2
(45) Date of Patent: Dec. 17, 2019

(54) DISHWASHER APPLIANCE WITH VENT DUCT MIXING

(71) Applicant: Haier US Appliance Solutions, Inc., Wilmington, DE (US)

(72) Inventors: Timothy Kopera, Louisville, KY (US); Justin James Brolley, Grapevine, TX (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 53 days.

(21) Appl. No.: 15/980,812

(22) Filed: May 16, 2018

(65) Prior Publication Data

US 2019/0350432 A1 Nov. 21, 2019

(51) Int. Cl.
*A47L 15/48* (2006.01)

(52) U.S. Cl.
CPC ..... *A47L 15/486* (2013.01); *A47L 15/488* (2013.01)

(58) Field of Classification Search
CPC .. A47L 15/486; A47L 15/488; A47L 15/4261; A47L 15/0052; A47L 15/14; A47L 15/4263
USPC ..... 34/565
See application file for complete search history.

(56) References Cited

U.S. PATENT DOCUMENTS 6,170,166 B1 * 1/2001 Johansen ..... A47L 15/48 34/595
7,124,765 B2 * 10/2006 Marks ..... A47L 15/4231 134/93
7,168,571 B2 * 1/2007 Gerteis ..... B04B 3/025 210/372
7,367,134 B2 * 5/2008 Osvatic ..... A47L 15/488 137/514
8,758,525 B2 6/2014 Kim
9,351,628 B2 * 5/2016 Erozkan ..... A47L 15/486
9,364,134 B2 6/2016 Kim
9,462,929 B2 * 10/2016 Park ..... A47L 15/481
9,510,728 B2 * 12/2016 Tuller ..... A47L 15/488
9,795,275 B2 * 10/2017 Hahm ..... A47L 15/481
9,907,451 B2 * 3/2018 Wu ..... A47L 15/483
10,363,499 B2 * 7/2019 Thrasher ..... F26B 11/026
2004/0177654 A1 * 9/2004 Marks ..... A47L 15/4231 68/13 A
2006/0175245 A1 * 8/2006 Gerteis ..... B04B 3/025 210/372

(Continued)

FOREIGN PATENT DOCUMENTS

CN 101278826 B 12/2010
GB 779003 A * 7/1957 ..... A47L 15/06
WO WO2017052796 A1 3/2017

*Primary Examiner* — Stephen M Gravini
(74) *Attorney, Agent, or Firm* — Dority & Manning, P.A.

(57) ABSTRACT

A dishwasher appliance includes a vent duct that is positioned within a door. A tub channel is separate from an ambient channel within the vent duct. An insert is positioned within the vent duct. The insert and the vent duct collectively define an outlet of the tub channel and an outlet of the ambient channel. The insert is positioned between the outlet of the tub channel and the outlet of the ambient channel along a transverse direction. The outlet of the tub channel and the outlet of the ambient channel each have a width along a lateral direction that is perpendicular to the transverse direction. The width of the outlet of the tub channel may be about equal to the width of the outlet of the ambient channel.

20 Claims, 6 Drawing Sheets

(56) References Cited

U.S. PATENT DOCUMENTS

| | | | | |
|---|---|---|---|---|
| 2009/0038661 | A1* | 2/2009 | Hildenbrand | A47L 15/483 134/56 D |
| 2010/0139714 | A1* | 6/2010 | Alessandrelli | A47L 15/488 134/105 |
| 2014/0238450 | A1* | 8/2014 | Bertram | A47L 15/0042 134/56 D |
| 2018/0000311 | A1* | 1/2018 | Ryu | A47L 15/0026 |
| 2018/0028043 | A1* | 2/2018 | Bowers | A47L 15/0028 |
| 2018/0103826 | A1* | 4/2018 | Jerg | A47L 15/4257 |

* cited by examiner

DISHWASHER APPLIANCE WITH VENT DUCT MIXING

FIELD OF THE INVENTION

The present subject matter relates generally to dishwasher appliances and more particularly to vent ducts for dishwasher appliances.

BACKGROUND OF THE INVENTION

Modern dishwashers typically include a wash chamber where detergent, water, and heat can be applied to clean food or other materials from dishes and other articles being washed. Various cycles may be part of the overall cleaning process. For example, a typical, user-selected cleaning option may include a wash cycle and rinse cycle (referred to collectively as a wet cycle), as well as a drying cycle. A pre-wash cycle may also be included as part of the wet cycle, and may be automatic or an option for particularly soiled dishes.

In one or more of these cycles, particularly during the drying cycle, it may be desirable to allow heated fluid—typically steam—to be vented from the wash chamber. Such venting allows for the removal of moisture from the dishes and helps dissipate heat from the drying cycle. Conventionally, one or more vents have been provided near the top of the front door of the dishwasher to allow for the escape of fluid from the wash chamber.

Recent improvements to the ventilation system have allowed for improved venting, in particular during the drying cycle. For example, the use of a port in a ventilation conduit allows for dry, ambient air to mix with the damp fluid flowing from the chamber of the dishwasher appliance. This mixing reduces condensation exterior to the dishwasher appliance, from the vented fluid. However, uniform mixing between the damp fluid flowing from the chamber of the dishwasher appliance and the dry, ambient air is difficult. In addition, the required ratio of dry air to damp fluid to provide adequate mixing is not constant during, for example, the entire dry cycle time period.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance includes a tub that defines a wash chamber. A door is mounted to the tub. A vent duct is positioned within the door. A tub channel and an ambient channel are positioned within the vent duct such that the tub channel is separate from the ambient channel. An inlet of the tub channel is positioned in fluid communication with the wash chamber when the door is closed, and an inlet of the ambient channel is positioned in fluid communication with ambient air about the tub. An insert is positioned within the vent duct. The insert and the vent duct collectively define an outlet of the tub channel and an outlet of the ambient channel. The insert is positioned between the outlet of the tub channel and the outlet of the ambient channel along a transverse direction. The outlet of the tub channel has a width along a lateral direction that is perpendicular to the transverse direction. The outlet of the ambient channel also has a width along the lateral direction. The width of the outlet of the tub channel is about equal to the width of the outlet of the ambient channel.

In a second example embodiment, a dishwasher appliance includes a tub that defines a wash chamber. A door is mounted to the tub. A vent duct is positioned within the door. A tub channel within the vent duct is separate from an ambient channel within the vent duct. An inlet of the tub channel is positioned in fluid communication with the wash chamber when the door is closed, and an inlet of the ambient channel positioned in fluid communication with ambient air about the tub when the door is closed. An insert is positioned within the vent duct. The insert and the vent duct collectively define an outlet of the tub channel and an outlet of the ambient channel. The insert is positioned between the outlet of the tub channel and the outlet of the ambient channel along a transverse direction. The outlet of the tub channel and the outlet of the ambient channel are aligned along the transverse direction. The outlet of the tub channel has a width along a lateral direction that is perpendicular to the transverse direction. The outlet of the ambient channel also has a width along the lateral direction. The width of the outlet of the tub channel is no less than four inches, and the width of the outlet of the ambient channel is no less than four inches.

A dishwasher appliance comprising a tub defining a wash chamber. A door mounted to the tub. A vent duct having a tub channel that is positioned separate from an ambient channel within the vent duct. An inlet of the tub channel is positioned in fluid communication with the wash chamber. An inlet of the ambient channel is positioned in fluid communication with ambient air about the tub. An insert is positioned within the vent duct. The insert and the vent duct collectively define an outlet of the tub channel and an outlet of the ambient channel. The insert is positioned between the outlet of the tub channel and the outlet of the ambient channel along a transverse direction. The outlet of the tub channel and the outlet of the ambient channel are aligned along the transverse direction such that air from the tub channel mixes with the ambient air from the ambient channel along the transverse direction. The outlet of the tub channel has a width along a lateral direction that is perpendicular to the transverse direction, and the outlet of the ambient channel has a width along the lateral direction. The width of the outlet of the ambient channel is no less than half the width of the outlet of the tub channel and no greater than the width of the outlet of the tub channel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
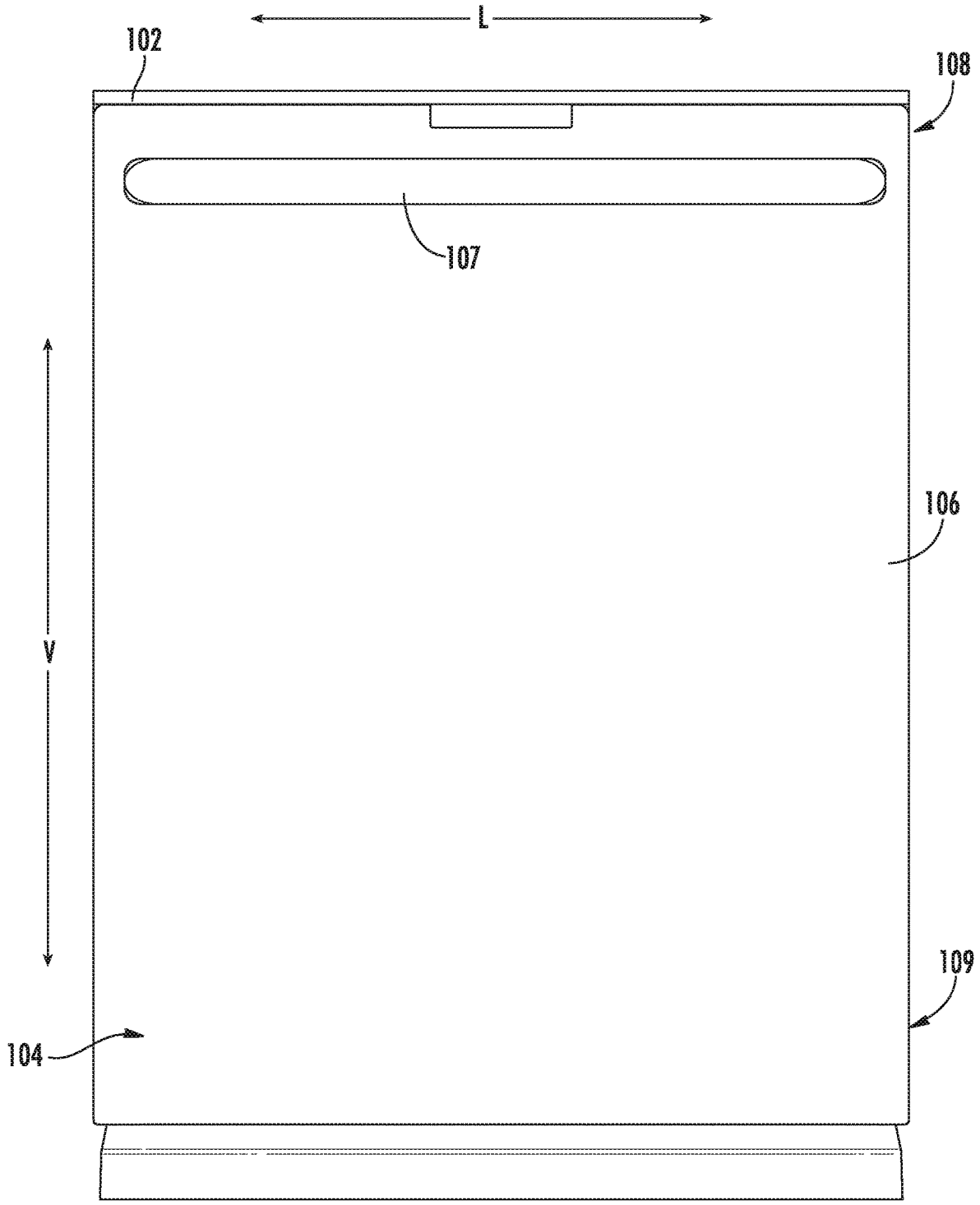
FIG. 1 is a front elevation view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
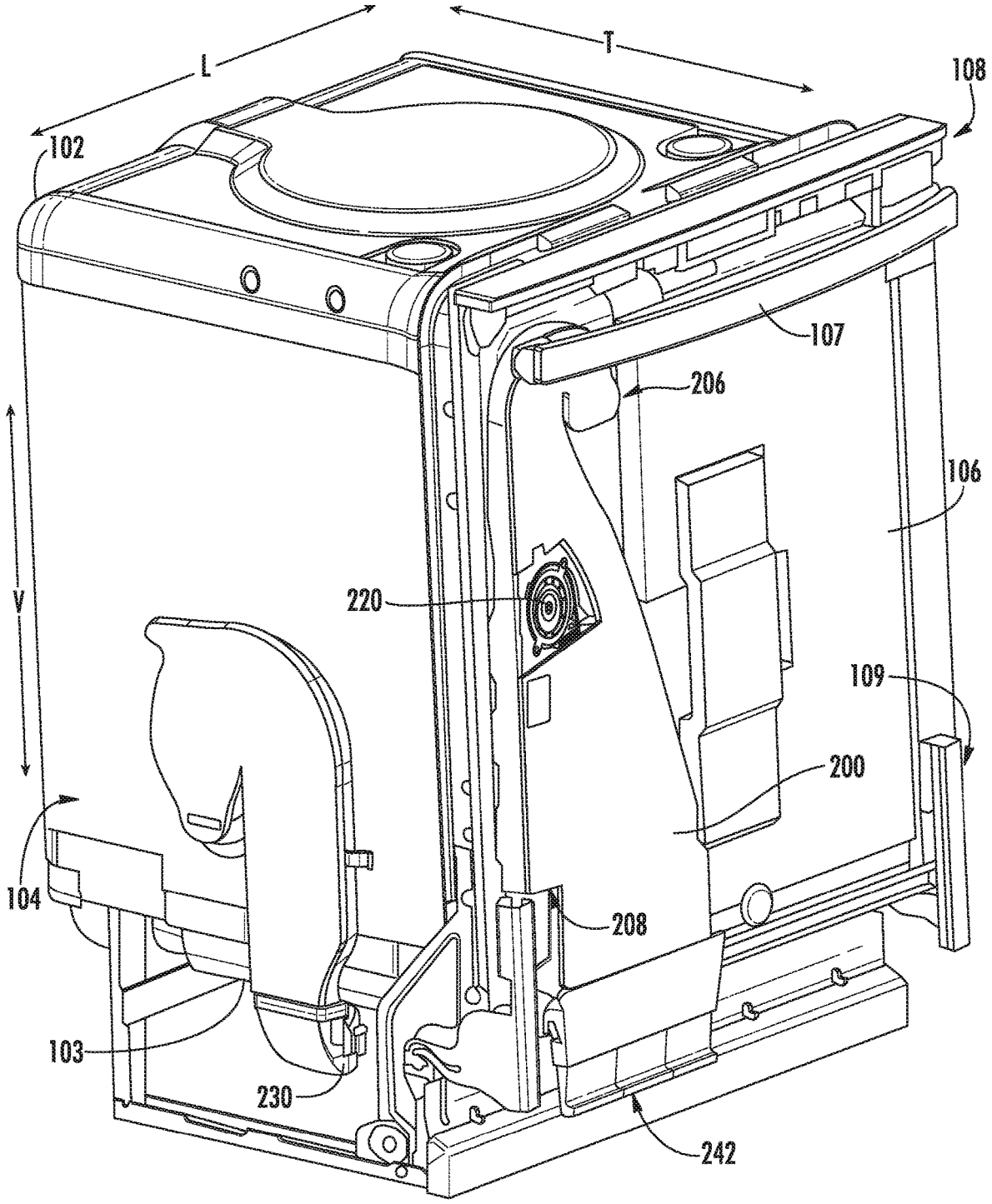
FIG. 2 is a perspective view of the example dishwasher appliance of FIG. 1 with various exterior components removed.

FIGS. 1 and 2 depict an example domestic dishwasher appliance 100 that may be configured in accordance with aspects of the present disclosure. It should be appreciated that the invention is not limited to any particular style, model, or other configuration of dishwasher, and that the embodiment depicted in FIGS. 1 and 2 is for illustrative purposes only.

For the particular embodiment of FIG. 2, the dishwasher appliance 100 includes a tub 102 that defines a wash chamber 104 within an interior of tub 102. Wash chamber 104 is configured for the receipt of articles for cleaning, such as dishes, cups, utensils, etc. Tub 102 includes a front opening (not shown) and a door 106 with a handle 107. Door 106 extends between a top portion 108 and a bottom portion 109 along the vertical direction V, and door 106 is hinged at or near bottom portion 109 of door 106 for movement between a normally closed vertical position (shown in FIGS. 1 and 2), wherein wash chamber 104 is sealed shut for washing operation, and a horizontal open position for loading and unloading of articles from wash chamber 104.

Dishwasher appliance 100 includes various components for applying wash fluid onto articles within wash chamber 104 and for supporting the articles within wash chamber 104. Such components are well known in the art and not shown or described in detail herein. As an example, dishwasher appliance 100 may include racks for supporting articles for washing within wash chamber 104, spray assemblies for directing flows of wash fluid onto the articles within the racks, silverware baskets, etc. The racks may be adapted for movement between an extended loading position in which the racks are substantially positioned outside the wash chamber 104, and a retracted position in which the racks are located inside the wash chamber 104. The spray assemblies may include rotatable spray arms mounted to tub 102 and/or one or the racks.

In general, dishwasher appliance 100 may utilize a variety of cycles to wash and, optionally, dry articles within wash chamber 104. For example, a wet cycle is utilized to wash articles. The wet cycle may include a main wash cycle and a rinse cycle, as well as an optional pre-wash cycle. During each such cycle, water or another suitable liquid may be utilized in wash chamber 104 to interact with and clean articles therein. The liquid may additionally mix with, for example, detergent or other various additives which are released into the chamber during various sub-cycles of the wet cycle. A drying cycle may be utilized to dry articles after washing. In generally, no liquid is sprayed or otherwise produced during the drying cycle.

During the drying cycle, liquid water on the articles within wash chamber 104 evaporates. The water vapor is flowable out of wash chamber 104 in order to improve drying performance of dishwasher appliance 100. Dishwasher appliance 100 includes various features for flowing air and water vapor from wash chamber 104, e.g., during drying cycles. In addition, dishwasher appliance 100 includes features for limiting or preventing condensation formation on a floor adjacent to dishwasher appliance 100 when air and water vapor flows from wash chamber 104.

As shown in FIG. 2, dishwasher appliance 100 includes a vent duct 200. Vent duct 200 is positioned within door 106. In alternative example embodiments, vent duct 200 may be mounted to tub 102. Dishwasher appliance 100 also includes an ambient fan 220 and a tub fan 230. Ambient fan 220 is mounted to vent duct 200 and is operable to flow ambient air from about dishwasher appliance 100 into vent duct 200. Tub fan 230 is mounted to tub 102 at a wall 103 of tub 102. Wall 103 of tub 102 may be a bottom wall as shown in FIG. 2. In alternative example embodiments, tub fan 230 may be mounted to any other suitable wall of tub 102, such as a side wall of tub 102. Tub fan 230 is operable to flow air from wash chamber 104 into vent duct 200. In particular, tub fan 230 may draw ambient air from below tub 102 into wash chamber 104 thereby pressuring wash chamber 104 relative to the ambient air about dishwasher appliance 100. The pressurized air and water vapor within wash chamber 104 exits wash chamber 104 via vent duct 200. Within vent duct 200, the ambient air from ambient fan 220 mixes with the wash chamber air from tub fan 230, as discussed in greater detail below.

A speed of ambient fan 220 and a speed of tub fan 230 are variable. Thus, e.g., a flow rate of air from wash chamber 104 into vent duct 200 may be advantageously adjusted by changing the speed of tub fan 230. Similarly, a flow rate of ambient air from about dishwasher appliance 100 into vent duct 200 may be advantageously adjusted by changing the speed of ambient fan 220. The speed of ambient fan 220 and the speed of tub fan 230 may be separately adjusted to advantageously adjust the ratio of ambient air from about dishwasher appliance 100 flowing into vent duct 200 to air from wash chamber 104 flowing into vent duct 200.

Figure 3:
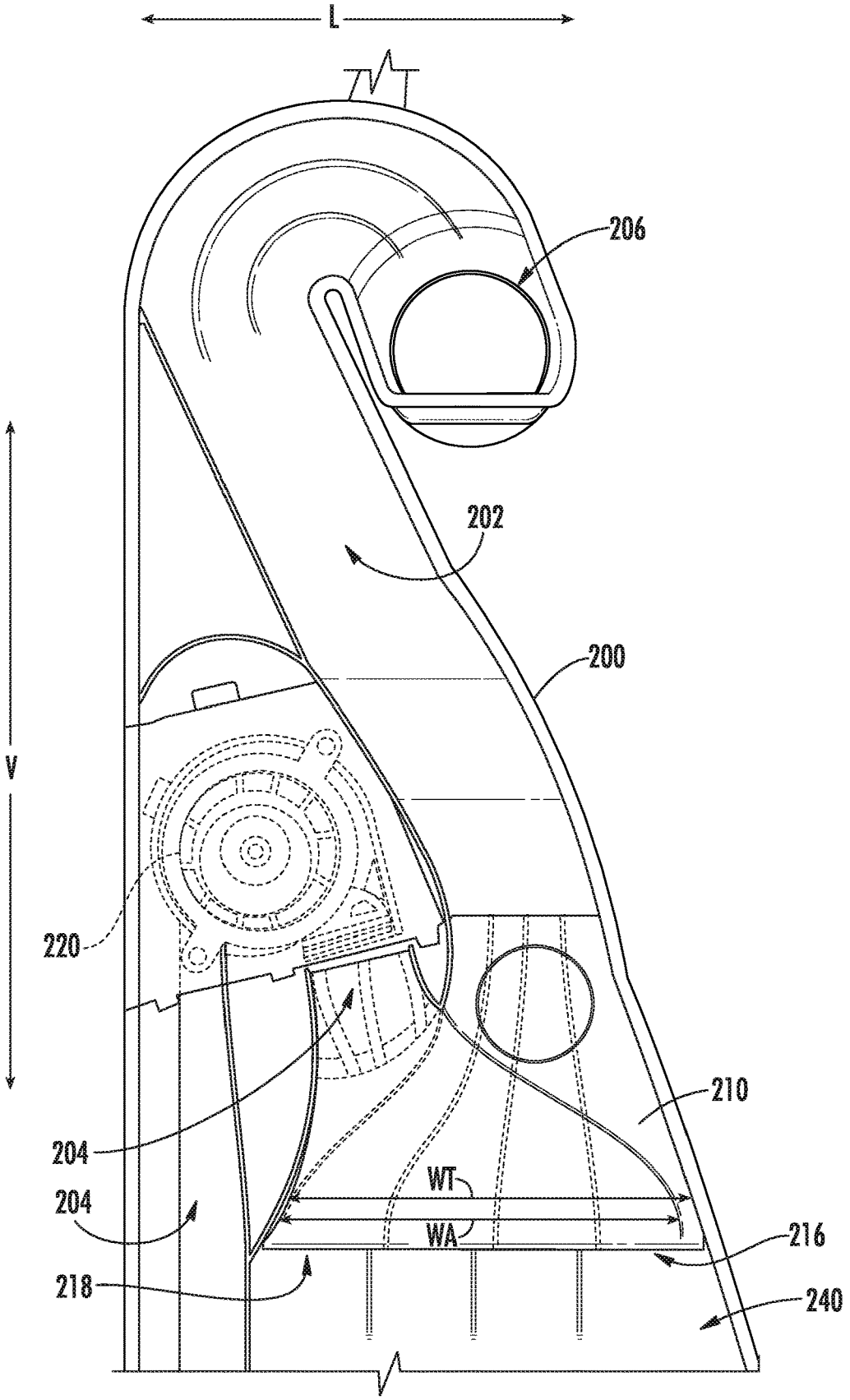
FIG. 3 is a section view of a vent duct of the example dishwasher appliance of FIG. 1.
Figure 4:
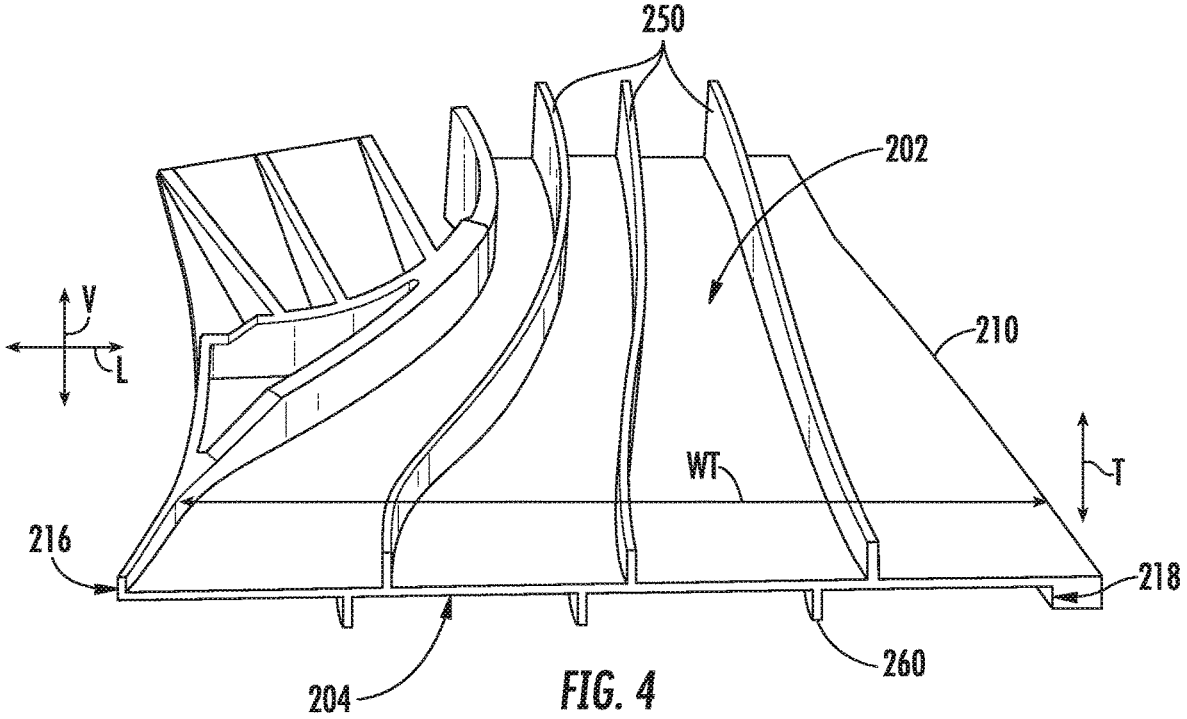
FIGS. 4 and 5 are perspective views of an insert of the example dishwasher appliance of FIG. 1.
Figure 5:
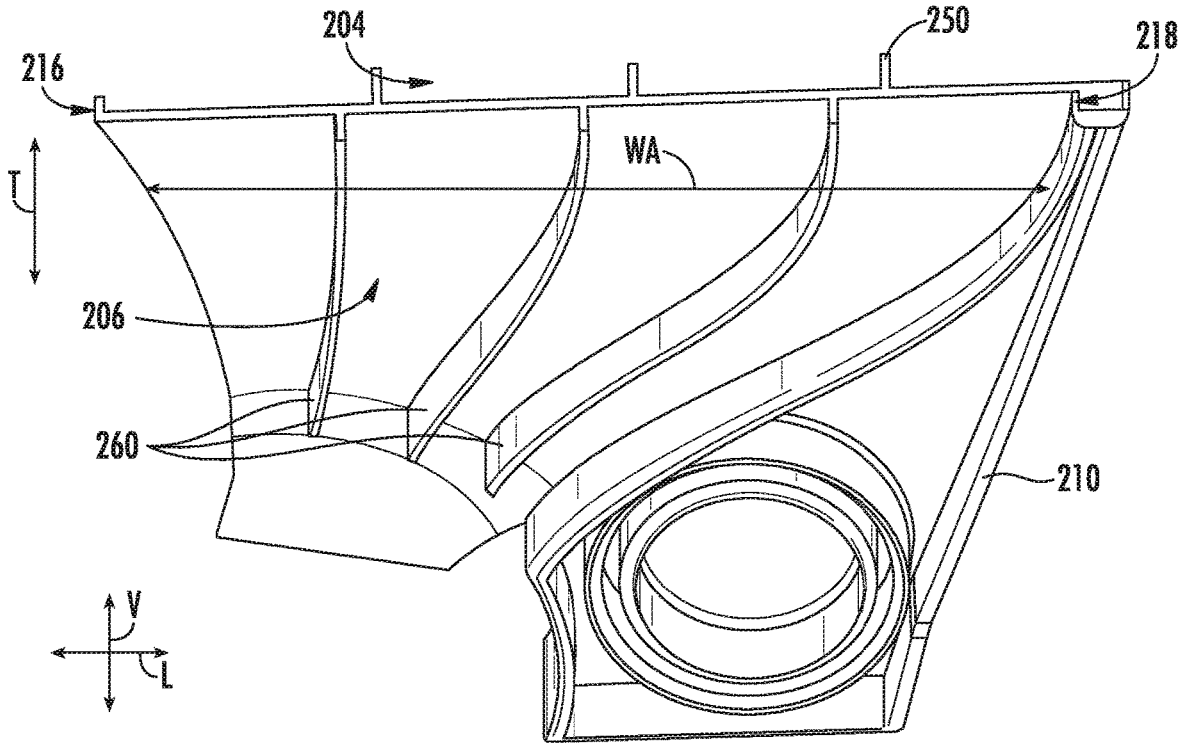
Figure 6:
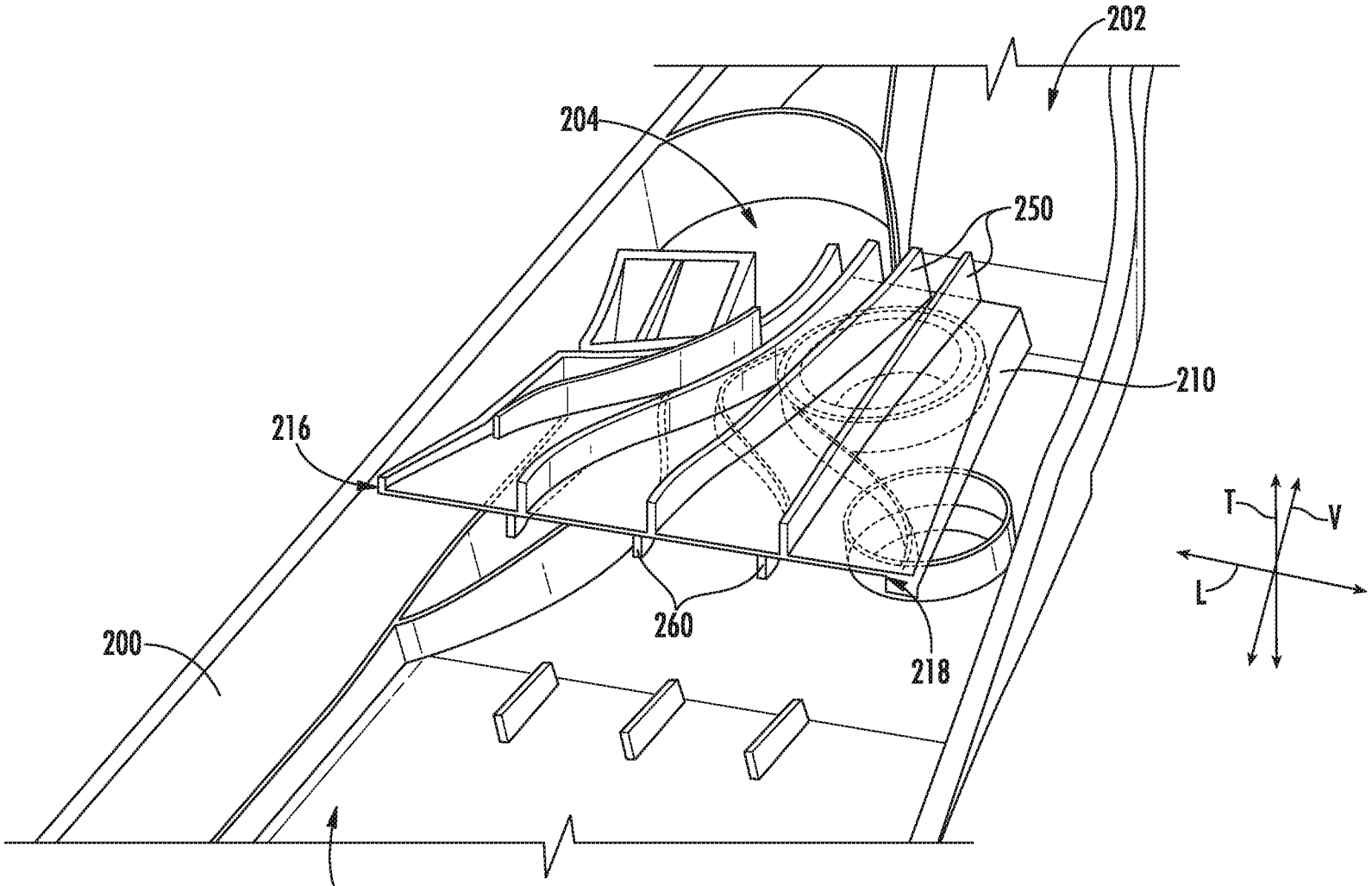
FIG. 6 is a partial, perspective view of the vent duct of FIG. 3 with the insert shown exploded from the vent duct.

FIG. 3 is a section view of vent duct 200. FIGS. 4 and 5 are perspective views of an insert 210 of dishwasher appliance 100, and FIG. 6 is a partial, perspective view of vent duct 200 with insert 210 shown exploded from vent duct 210. As discussed in greater detail below, vent duct 200 and insert 210 cooperate to facilitate mixing of the ambient air from ambient fan 220 and the wash chamber air from tub fan 230 to advantageously reduce or eliminate condensation of water vapor onto a floor adjacent dishwasher appliance 100 or other surface around dishwasher appliance 100. Vent duct 200 defines a vertical direction V, a transverse direction T and a lateral direction L. The vertical direction V, the transverse direction T and the lateral direction L are mutually perpendicular and form an orthogonal direction system.

With reference to FIG. 3 through 6, a tub channel 202 and an ambient channel 204 are positioned within vent duct 200. In particular, vent duct 200 may define at least a portion of tub channel 202 and at least a portion of ambient channel 204. Tub channel 202 is separate from ambient channel 204 within vent duct 200. For example, walls of vent duct 200 and/or insert 210 may be positioned between tub channel 202 and ambient channel 204 within vent duct 200. Thus, e.g., air within tub channel 202 may not mix with air from ambient channel 204 except at outlets of tub channel 202 and ambient channel 204, as discussed in greater detail below.

An inlet 206 of tub channel 202 is positioned in fluid communication with wash chamber 104, e.g., when door 106 is closed. Thus, air and water vapor from wash chamber 104 may flow into tub channel 202 at inlet 206 of tub channel 202, e.g., during operation of tub fan 230. An inlet 208 (FIG. 2) of ambient channel 204 is positioned in fluid communication with ambient air about tub 102. Thus, the ambient air about tub 102 may flow into ambient channel 204 at inlet 208 of ambient channel 204, e.g., during operation of ambient fan 220.

Insert 210 is positioned within vent duct 200. Insert 210 and vent duct 200 collectively define at least a portion of tub channel 202 and at least a portion of ambient channel 204. In particular, insert 210 and vent duct 200 collectively define an outlet 216 of tub channel 202 and an outlet 218 of ambient channel 204. After entering tub channel 202 at inlet 206 of tub channel 202, the air and water vapor from wash chamber 104 may flow through tub channel 202 to outlet 216 of tub channel 202, e.g., during operation of tub fan 230. Similarly, after entering ambient channel 204 at inlet 208 of ambient channel 204, the ambient air about tub 102 may flow through ambient channel 204 to outlet 218 of ambient channel 204, e.g., during operation of ambient fan 220. In such a manner, separate flows of relatively cool, dry ambient air and relatively hot, damp wash chamber air may flow through vent duct 200.

Insert 210 may be positioned between outlet 216 of tub channel 202 and outlet 218 of ambient channel 204 along the transverse direction T. Thus, insert 210 may block mixing of the separate flows of relatively cool, dry ambient air and relatively hot, damp wash chamber air within vent duct 200 upstream of outlets 216, 218. In other words, insert 210 may be positioned within vent duct 200 such that the flows of relatively cool, dry ambient air and relatively hot, damp wash chamber air mix downstream of insert 210 and outlets 216, 218. Outlets 216, 218 may be sized to facilitate mixing of the flows of relatively cool, dry ambient air and relatively hot, damp wash chamber air.

Figure 7:
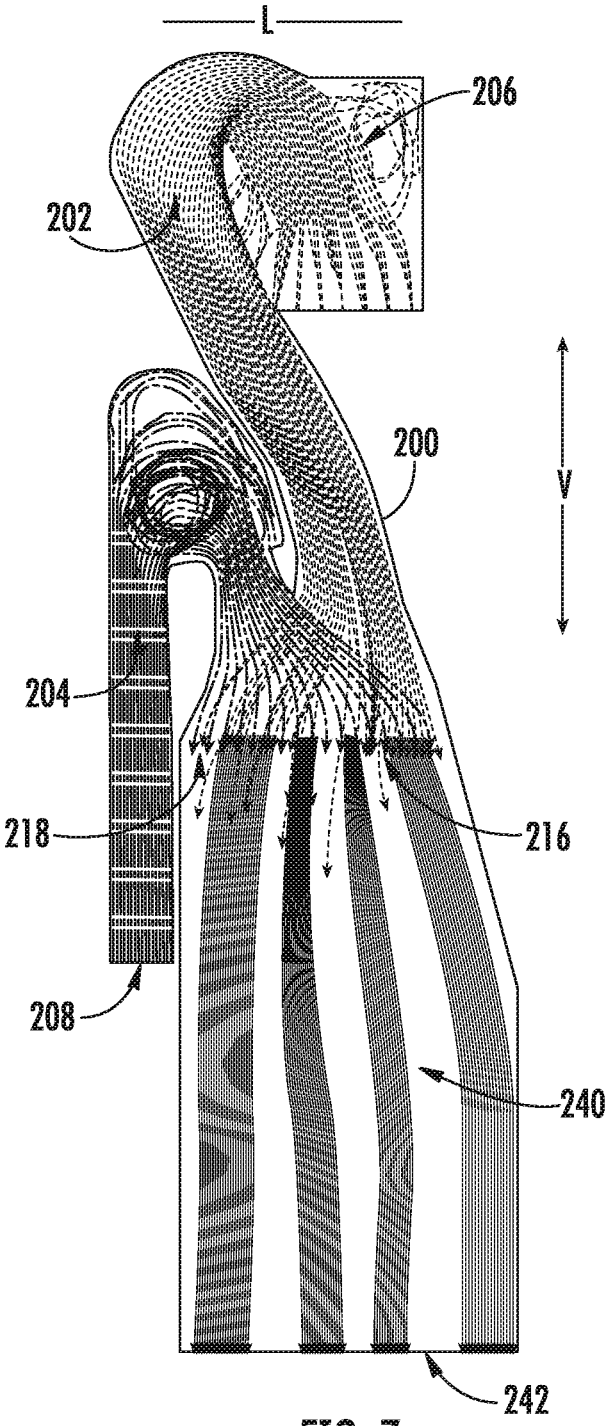
FIG. 7 is a schematic view of the vent duct of FIG. 3 and mixing between ambient air and wash chamber air within the vent duct.

Outlet 216 of tub channel 202 has a width WT along the lateral direction L. Similarly, outlet 218 of ambient channel 204 has a width WA along the lateral direction L. The width WT of outlet 216 of tub channel 202 may be about equal to the width WA of outlet 218 of ambient channel 204. As used herein, the term "about" means within ten percent of the stated width when used in the context of widths. The width WT of outlet 216 of tub channel 202 and the width WA of outlet 218 of ambient channel 204 may be suitably sized. For example, the width WT of outlet 216 of tub channel 202 may be no less than four inches (4"). Similarly, the width WA of outlet 218 of ambient channel 204 may be no less than four inches (4"). As another example, the width WA of outlet 218 of ambient channel 204 may be no less than half the width WT of outlet 216 of tub channel 202 and no greater than the width WT of outlet 216 of tub channel 202. Such sizing of outlets 216, 218 advantageously encourages uniform mixing of the separate flows of relatively cool, dry ambient air and relatively hot, damp wash chamber air from tub channel 202 and ambient channel 204 downstream of outlets 216, 218, e.g., as shown in FIG. 7.

Outlet 216 of tub channel 202 may also be aligned with outlet 218 of ambient channel 204 along the transverse direction T. Thus, e.g., outlet 216 of tub channel 202 may be positioned coplanar with outlet 218 of ambient channel 204, e.g., in a plane that is perpendicular to the vertical direction V. Such positioning of outlets 216, 218 advantageously encourages uniform mixing of the separate flows of relatively cool, dry ambient air and relatively hot, damp wash chamber air from tub channel 202 and ambient channel 204 downstream of outlets 216, 218, e.g., as shown in FIG. 7.

Inlet 208 of ambient channel 204 is positioned proximate bottom portion 109 of door 106. Conversely, outlet 218 of ambient channel 204 is spaced from bottom portion 109 of door 106. For example, outlet 218 of ambient channel 204 may be positioned at a middle portion of door 106 between top and bottom 108, 109 of door 106 along the vertical direction V. Thus, e.g., outlet 218 of ambient channel 204 may be positioned above inlet 208 of ambient channel 204 along the vertical direction V when door 106 is closed. Inlet 206 of tub channel 202 may be positioned at top portion 108 of door 106. Conversely, outlet 216 of tub channel 202 is spaced from top portion 108 of door 106. For example, outlet 216 of tub channel 202 may be positioned at the middle portion of door 106 between top and bottom 108, 109 of door 106 along the vertical direction V. Thus, e.g., outlet 216 of tub channel 202 may be positioned below inlet 206 of tub channel 202 along the vertical direction V when door 106 is closed.

A mixed air channel 240 is also positioned within vent duct 200. For example, mixed air channel 240 may be defined by vent duct 200. Mixed air channel 240 extends from outlets 216, 218 to an outlet 242 (FIG. 2) of mixed air channel 240. Outlet 242 of mixed air channel 240 is positioned at bottom portion 209 of door 206. Thus, e.g., mixed air channel 240 may extend downwardly along the vertical direction V from outlets 216, 218 to outlet 242 of mixed air channel 240 to outlet 242 of mixed air channel 240. The separate flows of relatively cool, dry ambient air and relatively hot, damp wash chamber air from tub channel 202 and ambient channel 204 may mix within mixed air channel 240 after exiting outlets 216, 218 and prior to exiting vent duct 200 at outlet 242 of mixed air channel 240.

Mixed air channel 240 has a length LM, e.g., along the vertical direction V. The length LM of mixed air channel 240 may be a suitable length. For example, the length LM of mixed air channel 240 along the vertical direction V may be selected to facilitate mixing of the separate flows of relatively cool, dry ambient air and relatively hot, damp wash chamber air from tub channel 202 and ambient channel 204. In particular, the length LM of mixed air channel 240 may be no less than twelve inches (12"). Such sizing of the length LM of mixed air channel 240 may advantageously allow sufficient time for the separate flows of relatively cool, dry ambient air and relatively hot, damp wash chamber air from tub channel 202 and ambient channel 204 to mix within mixed air channel 240 downstream of outlets 216, 218 and prior to such flow exiting mixed air channel 240 at outlet 242 of mixed air channel 240.

Vent duct 200 and/or insert 210 may include features for diffusing the separate flows of relatively cool, dry ambient air and relatively hot, damp wash chamber air along the lateral direction L prior to mixing of such separate flows. In particular, a cross-section of tub channel 202 in a plane that is perpendicular to the vertical direction V (when door 106 is closed) expands along the vertical direction V towards outlet 216 of tub channel 202. Similarly, a cross-section of ambient channel 204 in a plane that is perpendicular to the vertical direction V (when door 106 is closed) expands along the vertical direction V towards outlet 218 of ambient channel 204. By expanding towards outlets 216, 218, the velocities of fluid flow within tub channel 202 and ambient channel 204 may likewise decrease prior to contact between the separate flows of relatively cool, dry ambient air and relatively hot, damp wash chamber air at outlets 216, 218 thereby encouraging mixing between the separate flows.

Dishwasher appliance 100 may also include a first plurality of guide vanes 250 and a second plurality of guide vanes 260. First guide vanes 250 are positioned within tub channel 202. First guide vanes 250 are spaced apart along the lateral direction L, e.g., such that air within tub channel 202 flows between first guide vanes 250 along the vertical direction V. Each of first guide vanes 250 also extends between vent duct 200 and insert 210 along the transverse direction T adjacent outlet 216 of tub channel 202. First guide vanes 250 may be positioned and oriented to distribute air flowing through tub channel 202 across the width WT of outlet 216 of tub channel 202.

Second guide vanes 260 are positioned within ambient channel 204, e.g., opposite first guide vanes 250 about insert 210 along the transverse direction T. Second guide vanes 260 are spaced apart along the lateral direction L, e.g., such that air within ambient channel 204 flows between second guide vanes 260 along the vertical direction V. Each of second guide vanes 260 also extends between vent duct 200 and insert 210 along the transverse direction T adjacent outlet 218 of ambient channel 204. Second guide vanes 260 may be positioned and oriented to distribute air flowing through ambient channel 204 across the width WA of outlet 218 of ambient channel 204.

First guide vanes 250 and second guide vanes 260 may be integrally formed on or with vent duct 200 or insert 210. Thus, e.g., first guide vanes 250 may be formed on one of vent duct 200 or insert 210. Similarly, second guide vanes 260 may be formed on one of vent duct 200 or insert 210. Vent duct 200 and insert 210 may each be formed from separate pieces of molded plastic in certain example embodiments. In alternative example embodiments, vent duct 200 and insert 210 may be unitary, e.g., and formed with an additive manufacturing process.

The various components of dishwasher appliance 100 cooperate to uniformly mix ambient air with wash chamber air, e.g., during drying cycles. As shown in FIG. 7, the ambient air (shown with dot-dashed arrows) from ambient channel 204 mixes uniformly with the wash chamber air (shown with dashed arrows) from tub channel 202 along the lateral direction L. The mixture of ambient air and the wash chamber air is shown with the solid arrows. Thus, no unmixed separate stream of wash chamber air may exit outlet 242 of mixed air channel 240 and thereby form water condensation on a floor adjacent outlet 242 of mixed air channel 240.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a door mounted to the tub;

a vent duct positioned within the door, a tub channel and an ambient channel positioned within the vent duct such that the tub channel is separate from the ambient channel, an inlet of the tub channel positioned in fluid communication with the wash chamber when the door is closed, an inlet of the ambient channel positioned in fluid communication with ambient air about the tub, an insert positioned within the vent duct, the insert and the vent duct collectively defining an outlet of the tub channel and an outlet of the ambient channel, the insert positioned between the outlet of the tub channel and the outlet of the ambient channel along a transverse direction, wherein the outlet of the tub channel has a width along a lateral direction that is perpendicular to the transverse direction, the outlet of the ambient channel has a width along the lateral direction, and the width of the outlet of the tub channel is about equal to the width of the outlet of the ambient channel.

2. The dishwasher appliance of claim 1, further comprising an ambient fan mounted to the vent duct at the ambient channel, the ambient fan operable to flow the ambient air about the tub through the ambient channel from the inlet of the ambient channel to the outlet of the ambient channel.

3. The dishwasher appliance of claim 2, further comprising a tub fan mounted to tub at a wall of the tub, the tub fan operable to flow the air from the wash chamber through the tub channel from the inlet of the tub channel to the outlet of the tub channel.

4. The dishwasher appliance of claim 2, wherein a speed of the ambient fan and a speed of the tub fan are variable.

5. The dishwasher appliance of claim 2, wherein a cross-section of the ambient channel in a plane that is perpendicular to the vertical direction expands along a vertical direction between the ambient fan and the outlet of the ambient channel, the vertical direction perpendicular to the transverse and lateral directions.

6. The dishwasher appliance of claim 1, wherein the door extends between a top portion and a bottom portion along a vertical direction that is perpendicular to the transverse and lateral directions, and the inlet of the ambient channel is positioned proximate the bottom portion of the door.

7. The dishwasher appliance of claim 6, wherein a mixed air channel is positioned within the vent duct, the mixed air channel extends from the outlets of the ambient and tub channels to an outlet of the mixed air channel, and the outlet of the mixed air channel is positioned at the bottom portion of the door.

8. The dishwasher appliance of claim 7, wherein a length of the mixed air channel along the vertical direction is no less than twelve inches.

9. The dishwasher appliance of claim 1, further comprising a first plurality of guide vanes and a second plurality of guide vanes, wherein the first plurality of guide vanes is positioned within the tub channel, the first plurality of guide vanes are spaced apart along the lateral direction, and each of the first plurality of guide vanes extends between the vent duct and the insert along the transverse direction adjacent the outlet of the tub channel, and wherein the second plurality of guide vanes is positioned within the ambient channel, the second plurality of guide vanes are spaced apart along the lateral direction, and each of the second plurality of guide vanes extends between the vent duct and the insert along the transverse direction adjacent the outlet of the ambient channel.

10. The dishwasher appliance of claim 9, wherein the first plurality of guide vanes is formed on one of the vent duct and the insert.

11. The dishwasher appliance of claim 9, wherein the second plurality of guide vanes is formed on one of the vent duct and the insert.

12. The dishwasher appliance of claim 1, wherein a cross-section of the tub channel in a plane that is perpendicular to a vertical direction expands along the vertical direction towards the outlet of the tub channel, the vertical direction perpendicular to the transverse and lateral directions.

13. The dishwasher appliance of claim 12, wherein a cross-section of the ambient channel in a plane that is perpendicular to the vertical direction expands along the vertical direction towards the outlet of the ambient channel.

14. The dishwasher appliance of claim 1, wherein the width of the outlet of the tub channel is no less than four inches, and the width of the outlet of the ambient channel is no less than four inches.

15. A dishwasher appliance, comprising:

a tub defining a wash chamber;

a door mounted to the tub;

a vent duct positioned within the door, a tub channel within the vent duct is separate from an ambient channel within the vent duct, an inlet of the tub channel positioned in fluid communication with the wash chamber when the door is closed, an inlet of the ambient channel positioned in fluid communication with ambient air about the tub when the door is closed, an insert positioned within the vent duct, the insert and the vent duct collectively defining an outlet of the tub channel and an outlet of the ambient channel, the insert positioned between the outlet of the tub channel and the outlet of the ambient channel along a transverse direction, wherein the outlet of the tub channel and the outlet of the ambient channel are aligned along the transverse direction, the outlet of the tub channel has a width along a lateral direction that is perpendicular to the transverse direction, the outlet of the ambient channel has a width along the lateral direction, the width of the outlet of the tub channel is no less than four inches, and the width of the outlet of the ambient channel is no less than four inches.

16. The dishwasher appliance of claim 15, further comprising an ambient fan and a tub fan, the ambient fan mounted to the vent duct at the ambient channel, the ambient fan operable to flow the ambient air about the tub through the ambient channel from the inlet of the ambient channel to the outlet of the ambient channel, the tub fan mounted to tub at a wall of the tub, the tub fan operable to flow the air from the wash chamber through the tub channel from the inlet of the tub channel to the outlet of the tub channel, and wherein a speed of the ambient fan and a speed of the tub fan are variable.

17. The dishwasher appliance of claim 15, wherein the door extends between a top portion and a bottom portion along a vertical direction that is perpendicular to the transverse and lateral directions, a mixed air channel is positioned within the vent duct, the mixed air channel extends from the outlets of the ambient and tub channels to an outlet of the mixed air channel along the vertical direction, the outlet of the mixed air channel is positioned at the bottom portion of the door, and a length of the mixed air channel along the vertical direction is no less than twelve inches.

18. The dishwasher appliance of claim 15, further comprising a first plurality of guide vanes and a second plurality of guide vanes, wherein the first plurality of guide vanes is positioned within the tub channel, the first plurality of guide vanes are spaced apart along the lateral direction, and each of the first plurality of guide vanes extends between the vent duct and the insert along the transverse direction adjacent the outlet of the tub channel, and wherein the second plurality of guide vanes is positioned within the ambient channel, the second plurality of guide vanes are spaced apart along the lateral direction, and each of the second plurality of guide vanes extends between the vent duct and the insert along the transverse direction adjacent the outlet of the ambient channel.

19. The dishwasher appliance of claim 15, wherein a cross-section of the tub channel in a plane that is perpendicular to a vertical direction expands along the vertical direction towards the outlet of the tub channel, a cross-section of the ambient channel in a plane that is perpendicular to the vertical direction expands along the vertical direction towards the outlet of the ambient channel, and the vertical direction is perpendicular to the transverse and lateral directions.

20. A dishwasher appliance, comprising:

a tub defining a wash chamber;

a door mounted to the tub;

a vent duct having a tub channel that is positioned separate from an ambient channel within the vent duct, an inlet of the tub channel positioned in fluid communication with the wash chamber, an inlet of the ambient channel positioned in fluid communication with ambient air about the tub, an insert positioned within the vent duct, the insert and the vent duct collectively defining an outlet of the tub channel and an outlet of the ambient channel, the insert positioned between the outlet of the tub channel and the outlet of the ambient channel along a transverse direction, wherein the outlet of the tub channel and the outlet of the ambient channel are aligned along the transverse direction such that air from the tub channel mixes with the ambient air from the ambient channel along the transverse direction, the outlet of the tub channel has a width along a lateral direction that is perpendicular to the transverse direction, the outlet of the ambient channel has a width along the lateral direction, the width of the outlet of the ambient channel is no less than half the width of the outlet of the tub channel and no greater than the width of the outlet of the tub channel.

* * * * *